US005620462A

United States Patent [19]

Valenti

[11] Patent Number: 5,620,462

[45] Date of Patent: Apr. 15, 1997

[54] LIQUID VITAMIN AND MEDICINE DISPENSER FOR INFANTS AND TODDLERS

[76] Inventor: Diane L. Valenti, 152 Holiday Blvd., Center Moriches, N.Y. 11934

[21] Appl. No.: 431,436

[22] Filed: May 1, 1995

[51] Int. Cl.[6] ..... A61J 17/00

[52] U.S. Cl. ..... 606/234; 606/236; 604/77; 604/79; 215/11.1; 215/11.3

[58] Field of Search ..... 604/77, 79; 606/234, 606/236; 215/11.1, 11.3

[56] References Cited

U.S. PATENT DOCUMENTS

| | | | |
|---|---|---|---|
| 224,557 | 2/1880 | Potter | 215/11.1 |
| 732,630 | 6/1903 | Hall | 215/11.1 |
| 1,510,363 | 3/1923 | Wanger | 215/11.1 |
| 1,656,157 | 1/1928 | Correnti | 215/11.1 |
| 3,028,983 | 4/1962 | Barr | 215/11.1 |
| 4,898,291 | 2/1990 | Sailors | 215/11.4 |
| 5,078,734 | 1/1992 | Noble | 66/236 |
| 5,123,915 | 6/1992 | Miller et al. | 606/234 |
| 5,176,705 | 1/1993 | Noble | 606/236 |
| 5,244,122 | 9/1993 | Botts | 604/77 |
| 5,354,274 | 10/1994 | Demeter et al. | 604/77 |
| 5,431,680 | 7/1995 | Jones | 606/236 |

*Primary Examiner*—V. Millin
*Assistant Examiner*—D. Blyveis
*Attorney, Agent, or Firm*—Michael I. Kroll

[57] ABSTRACT

A liquid vitamin and medicine dispenser for infants and toddlers, comprising a flexible mask contoured to the shape of a mouth of an infant/toddler to provide support. A lock assembly is centrally mounted into the flexible mask. A nipple having a pinhole therein is secured into the lock assembly on an inner side of the flexible mask, so that the infant/toddler can suck on the nipple. A vial is mounted in a removable manner into the lock assembly on an outer side of the flexible mask. A liquid vitamin/medicine can be placed into the vial to flow into the nipple, allowing the infant/toddler to suck the liquid out of the nipple.

3 Claims, 2 Drawing Sheets

LIQUID VITAMIN AND MEDICINE DISPENSER FOR INFANTS AND TODDLERS

BACKGROUND OF THE INVENTION

1. Field of the Invention

The instant invention relates generally to medicine droppers and more specifically it relates to a liquid vitamin and medicine dispenser for infants and toddlers.

2. Description of the Prior Art

Numerous medicine droppers have been provided in prior art in which each consists of a small glass tube with a hollow rubber bulb at one end for drawing in a liquid medicine and releasing the liquid medicine in drops from a small opening at another end. While these units may be suitable for the particular purpose to which they address, they would not be as suitable for the purposes of the present invention as heretofore described.

SUMMARY OF THE INVENTION

A primary object of the present invention is to provide a liquid vitamin and medicine dispenser for infants and toddlers that will overcome the shortcomings of the prior art devices.

Another object is to provide a liquid vitamin and medicine dispenser for infants and toddlers that is similar in shape to a pacifier, which will enable each infant and toddler to suck down the liquid rather than having the liquid squirted into their mouths with a dropper, which can cause choking.

An additional object is to provide a liquid vitamin and medicine dispenser for infants and toddlers that contains a removable dosage vial, which can be filled with a proper amount of the liquid, so that the liquid can flow into a nipple with a pinhole in it, allowing the infants and toddlers to suck down the liquid.

A further object is to provide a liquid vitamin and medicine dispenser for infants and toddlers that is simple and easy to use.

A still further object is to provide a liquid vitamin and medicine dispenser for infants and toddlers that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 2:
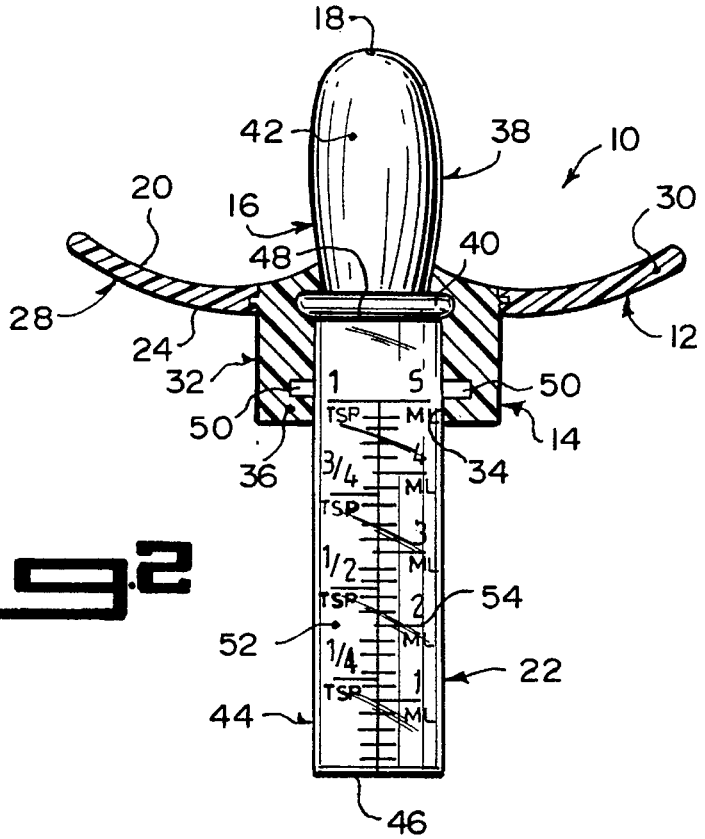
FIG. 2 is a cross sectional view taken along line 2—2 in FIG. 1.
Figure 1:
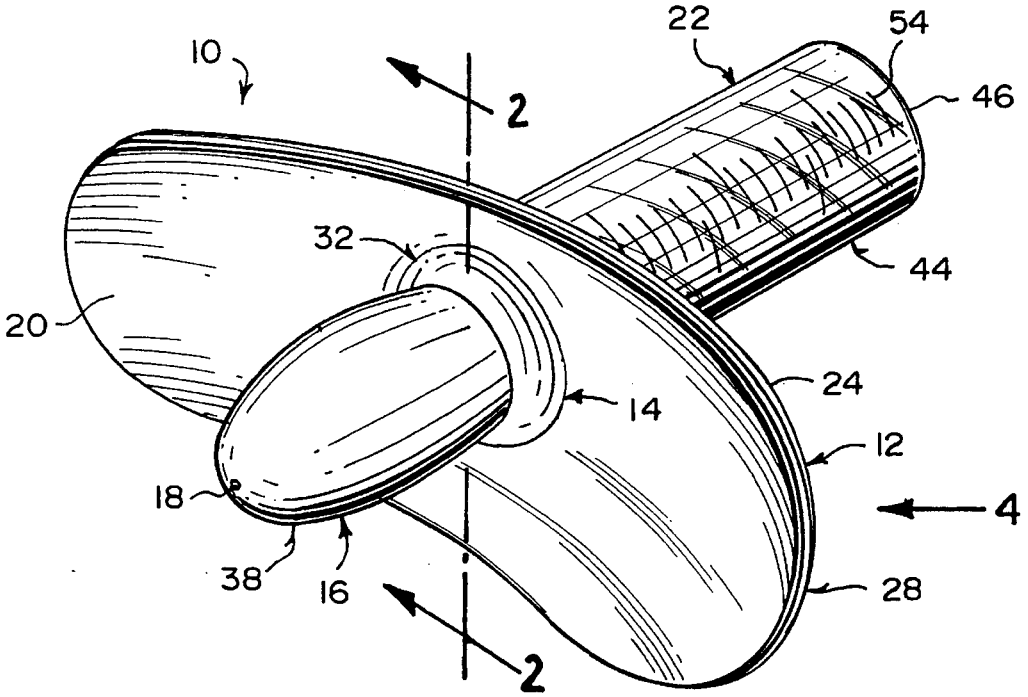
FIG. 1 is a rear perspective view of the instant invention.

Turning now descriptively to the drawings, in which similar reference characters denote similar elements throughout the several views, FIGS. 1 through 4 illustrate a liquid vitamin and medicine dispenser 10 for infants and toddlers, comprising a flexible mask 12 contoured to the shape of a mouth of an infant/toddler to provide support. A lock assembly 14 is centrally mounted into the flexible mask 12. A nipple 16 having a pinhole 18 therein is secured into the lock assembly 14 on an inner side 20 of the flexible mask 12, so that the infant/toddler can suck on the nipple 16. A vial 22 is mounted in a removable manner into the lock assembly 14 on an outer side 24 of the flexible mask 12. A liquid vitamin/medicine 26 can be placed into the vial 22 to flow into the nipple 16, allowing the infant/toddler to suck the liquid 26 out of the nipple 16. The flexible mask 12 is a curved bean-shaped disk 28. The flexible mask 12 is fabricated out of a molded plastic material 30.

The lock assembly 14 is a hollow cylindrical housing 32, having a socket 34 on the outer side 24 of the flexible mask 12 to receive the vial 22 therein. The lock assembly 14 is fabricated out of a solid hard plastic 36.

The nipple 16 is a compressible hollow bulb-shaped member 38 having a beaded neck 40, which is retained within the lock assembly 14. The nipple 16 is fabricated out of a latex material 42.

The vial 22 is a cylindrical body 44 having a closed end 46 and an open end 48, to hold the liquid vitamin/medicine 26 therein. The vial 22 includes a pair of oppositely disposed lock tabs 50 adjacent the open end 48, which when inserted into the lock assembly 14 will be retained therein in the removable manner, with the open end 48 up against the nipple 16.

Figure 3:
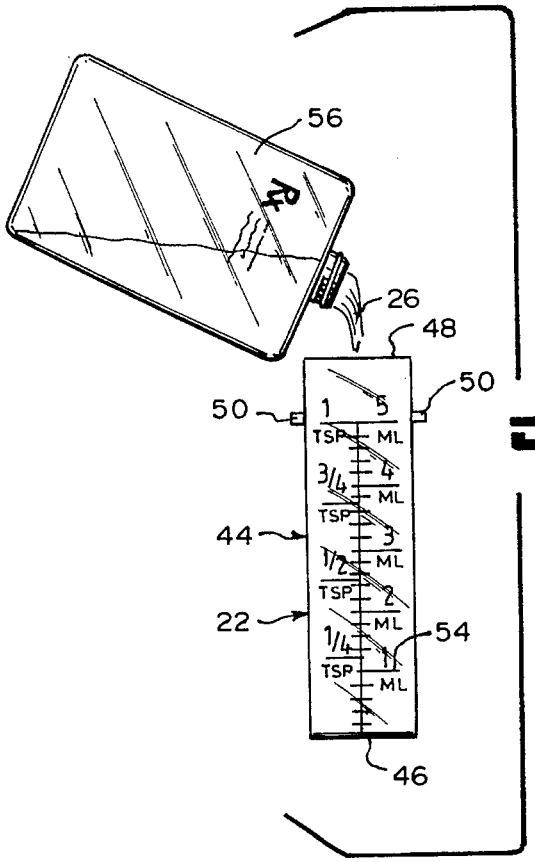
FIG. 3 is an elevational view of the dosage vial being filled with liquid medicine or vitamins.
Figure 4:
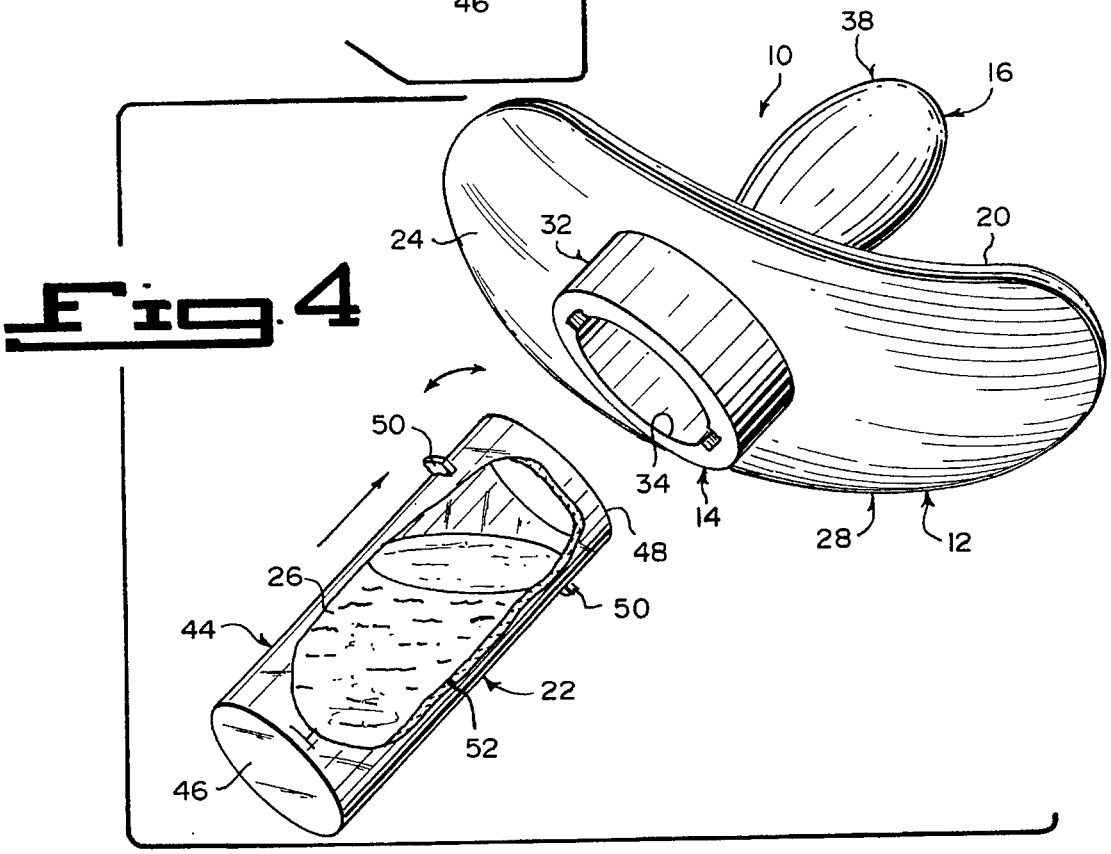
FIG. 4 is a front perspective view taken in the direction of arrow 4 in FIG. 1, with the dosage vial exploded therefrom and broken away.

The vial 22 is fabricated out of a transparent plastic material 52, so that a person can see the liquid vitamin/medicine 26 within the vial 22. The vial 22 includes a measurement marking scale 54 thereon, so that a proper dosage of the liquid vitamin/medicine 26 can be poured into the vial 22 from a container 56, as shown in FIG. 3.

OPERATION OF THE INVENTION

To use the liquid vitamin and medicine dispenser 10, the following steps should be taken:

1. Remove the vial 22 from the lock assembly 14 by disengaging the lock tabs 50 from within the socket 34.
2. Pour the liquid vitamin/medicine 26 from the container 56 into the open end 48.
3. Read the measurement marking scale 54 until the proper dosage is placed into the vial 22.
4. Connect the vial 22 to the lock assembly 14 by engaging the lock tabs 50 back into the socket 34.
5. Place the nipple 16 into the mouth of the infant/toddler with the flexible mask 12 against the mouth.
6. Allow the infant/toddler to suck the liquid 26 out of the pinhole 18 in the nipple 16.

LIST OF REFERENCE NUMBERS

10 liquid vitamin and medicine dispenser
12 flexible mask
14 lock assembly
16 nipple
18 pinhole in 16
20 inner side of 12
22 vial
24 outer side of 12
26 liquid vitamin/medicine
28 curved bean-shaped disk for 12
30 molded plastic material of 12
32 hollow cylindrical housing for 14
34 socket in 32
36 solid hard plastic of 14
38 compressible hollow bulb-shaped member for 16
40 beaded neck on 38
42 latex material of 16
44 cylindrical body for 22
46 closed end on 44
48 open end on 44
50 lock tab on 22
52 transparent plastic material of 22
54 measurement marking scale on 22
56 container It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A liquid vitamin and medicine dispenser for infants and toddlers comprising:

a) a flexible mask contoured to the shape of a mouth of an infant/toddler to provide support, said flexible mask being a curved bean-shaped disk, said flexible mask being fabricated out of a molded plastic material;

b) a lock assembly centrally mounted into said flexible mask, said lock assembly being a hollow cylindrical housing having a socket on the outer side of said flexible mask to receive said vial therein, said lock assembly being fabricated out of a solid hard plastic;

c) a nipple having a pinhole therein secured into said lock assembly on an inner side of said flexible mask, so that the infant/toddler can suck on said nipple, said nipple being a compressible hollow bulb-shaped member having a beaded neck, which is retained within said lock assembly, said nipple being fabricated out of a latex material; and d) a vial mounted in a removable manner into said lock assembly on an outer side of said flexible mask, so that a liquid vitamin/medicine can be placed into said vial to flow into said nipple, allowing the infant/toddler to suck the liquid out of said nipple, said vial being a cylindrical body having a closed end and an open end, to hold the liquid vitamin/medicine therein, said vial including a pair of oppositely disposed lock tabs adjacent the open end, which when inserted into said lock assembly will be retained therein in the removable manner, with the open end up against said nipple.

2. A liquid vitamin and medicine dispenser for infants and toddlers as recited in claim 1, wherein said vial is fabricated out of a transparent plastic material, so that a person can see the liquid vitamin/medicine within said vial.

3. A liquid vitamin and medicine dispenser for infants and toddlers as recited in claim 2, wherein said vial includes a measurement marking scale thereon, so that a proper dosage of the liquid vitamin/medicine can be poured into said vial.

* * * * *